US006374720B1

(12) United States Patent
Tedde

(10) Patent No.: US 6,374,720 B1
(45) **Date of Patent: *Apr. 23, 2002**

(54) FIREARM WITH AN EXPANSION CHAMBER WITH VARIABLE VOLUME

(76) Inventor: Salvatore Tedde, Via Torres, 1, 07010 (SS) Ardara (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/444,508

(22) Filed: Nov. 22, 1999

Related U.S. Application Data

(63) Continuation of application No. PCT/IT98/00128, filed on May 22, 1998, now abandoned.

(30) Foreign Application Priority Data

May 23, 1997 (IT) ..... RM97A0309

(51) Int. Cl.[7] ..... F41A 5/28
(52) U.S. Cl. ..... 89/193; 42/78
(58) Field of Search ..... 42/76.01, 78; 89/14.05, 89/14.5, 193

(56) References Cited

U.S. PATENT DOCUMENTS

| | | | | | |
|---|---|---|---|---|---|
| 2,801,416 A | | 8/1957 | Evans et al. | | |
| 3,380,344 A | | 4/1968 | Bucklisch et al. | | |
| 3,381,403 A | | 5/1968 | Murdoch | | |
| 4,019,423 A | * | 4/1977 | Johnson | 89/178 | |
| 4,126,077 A | * | 11/1978 | Quesnel | 89/1.704 | |
| 4,833,808 A | * | 5/1989 | Strahan | 42/1.06 | |
| 5,279,200 A | * | 1/1994 | Rose | 42/97 | |
| 5,337,649 A | * | 8/1994 | Franzen et al. | 89/33.04 | |

FOREIGN PATENT DOCUMENTS

| | | | | |
|---|---|---|---|---|
| CS | 66954 | * | 2/1940 | 42/76.01 |
| DE | 0055010 | | 1/1989 | |
| DE | 3706532 | | 9/1996 | |
| FR | 0491222 | | 5/1919 | |
| FR | 1496220 | | 9/1967 | |
| FR | 2450436 | | 9/1980 | |
| GB | 0012477 | | 3/1919 | |
| GB | 0437027 | | 10/1935 | |
| WO | 9201902 | | 2/1992 | |
| GB | 371 | * | of 1887 | 89/14.05 |

* cited by examiner

*Primary Examiner*—Stephen M. Johnson
(74) *Attorney, Agent, or Firm*—Stevens, Davis, Millers & Mosher, LLP

(57) ABSTRACT

A device that is capable of adjusting the volume available to combustion gases following their expansion in a firearm includes (i) an expansion chamber connected to the barrel of the firearm through (ii) at least one connection hole disposed near the beginning of the rifling; (iii) a front calibration screw capable of being rotated into or out of the expansion chamber so as to calibrate the firearm for a particular ammunition; and (iv) a back calibration screw capable of being rotated into or out of the expansion chamber so as to calibrate the firearm for a particular ammunition. Adjustment of the positions of the front calibration screw and the back calibration screw facilitates the adjustment in the volume of the expansion chamber. By virtue of the adjustable volume expansion chamber, it is possible to adapt the physical features of the firearm to the specific type of ammunition that is to be employed, such as, for example, a high charge load cartridge.

19 Claims, 7 Drawing Sheets

0 5 10 15 20
1
9
10
11
12
13
13a
14
16

FIREARM WITH AN EXPANSION CHAMBER WITH VARIABLE VOLUME

This application is a continuation of PCT/IT98/00128, filed on May 22, 1998, now abandoned.

FIELD OF THE INVENTION

The present invention relates to the field of firearms, more particularly it is an improvement of the constructive technique of any type of firearms, like for example semiautomatic and non semiautomatic hunting rifles, military assault guns, machine guns, gunnery in general, as well as shotguns, so as to allow the employment of different types of ammunitions in absolutely safe conditions.

BACKGROUND OF THE INVENTION

According to the present invention, a device is provided which allows the user to increase or decrease as it suits him and according to the needs of the specific moment, the initial values of the pressure generated by the travelling charge (powder), following its ignition.

Since the pressure that builds up during gunpowder combustion is directly accountable for the speed which is given to the projectile, it is possible to adjust its speed and ensuing kinetic energy, and in so doing varying the amount of energy given up to the target which is located at a certain distance.

In such a way it is advantageously possible to study new types of ammunitions (new calibers with particular amounts of propellent) with the aim of attaining a better quality from both the ballistics and the construction points of view.

It is known, from U.S. Pat. No. 3,381,403, a projecting unit for projecting a syringe projectile for administering of drugs, medicines and the like to animals.

This known apparatus is externally similar to a firearm such as a rifle or a pistol, but it is specifically designed to fire only explosive ballistic cartridge blank in order to provide propulsive power to a syringe projectile by means of a pre-expansion chamber.

The arrangement disclosed in U.S. Pat. No. 3,381,403 does not allow the use of different kind of ammunitions with the same firearm, but instead is only intended for the use of syringe projectiles having different weight with a same kind of blank cartridge.

It is also known, from ER 491.222, a device suitable for reducing the range of a gun or cannon (without varying the inclination of the barrel) by discharging a desired amount of the combustion gases, produced by the gunpowder combustion contained in the ammunitions, in the external environment. For this aim, FR 491.222 discloses a gun having a combustion gas discharging conduit that may be closed or opened by the user.

In this latter case, the discharged combustion gases are lost and they are not re-utilized for propelling the projectile.

The firearms known in the art were conceived and designed to endure and operate with explosive charges of a certain intensity, therefore the pressure that is generated in employing ammunitions with the same caliber but with bigger charges is very dangerous, as much higher pressure values are reached when compared with those that are expected at the designing stage The "liveliness" of the powder and the limited volume available to combustion gases when they expand, a volume which is made available by the initial headway motion of the projectile, are concurring factors when pressure builds up to unacceptable values.

In these conditions, both the case and the weapon are mechanically strained, whereas the bullet receives a "ram blow", which negatively affects its precision on the target.

Besides that, the mobile recoiling parts respond in such a way as to be factors that greatly increase the possibilities that structural failures occur in whatever weapon, with consequences that can be easily guessed, especially in machine-gun-type weapons, like said machine guns and military assault shotguns with a shooting range beyond 550–650 shots per minute.

It is well known that gunpowder has two important inherent features, the first being that the oxygen which is necessary for combustion to take place is intimately contained within the chemical formula of the gunpowder itself, therefore this can burn in the absence of air, that is in an airtight environment (case), whereas the second feature which is ever more important, is that the rate at which said combustion occurs is proportional to the pressure itself.

In other words, when the percussion has been triggered and it gives way to the beginning of the combustion of the charge contained in a case, the gas which is given off yields to a pressure increase around that charge which still has to burn. At this point the fundamental phenomenon because of which the powder reacts to yield a blast from being a simple combustion takes place.

This sudden pressure increase strongly accelerates combustion, with an ensuing production of further gas and a pressure increase, therefore a higher combustion rate.

Such a process is so fast that it seems to be instantaneous.

To understand the importance of the phenomena which have been described so far, it is enough to point out that an amount of gunpowder that only needs a couple of seconds to burn in the open air is consumed within a couple of thousandths of a second when it is compelled in a case.

Although very rapid, the combustion process described so far is the result of a sequence of events that can be controlled.

From the moment when the initiator lights the charge of a cartridge which is located in the chamber, the pressure starts to undergo a rapid increase, and the only "yielding" point within the blasting volume inside the case is the projectile, therefore compressed gases exert their propulsive action forcing the projectile out of the neck of the case and accelerating it along the muzzle (where the word "muzzle" is to be understood to include the entire barrel from the front end of the cartridge chamber to the exit of the barrel).

Within this very limited time lapse, the best possible ratio must be attained between the rate of production of the gases that are given off by charge combustion and the rate at which the volume that they occupy increases when they expand.

It is essential to point out that the above volume is that given by the space between the bottom of the case and the base of the projectile. Therefore it linearly augments as the latter moves forward along the muzzle.

Therefore it is clear that the above ratio is extremely important and delicate.

If the charge burns too rapidly when combustion has just begun and the projectile has only travelled a short way along the muzzle, too much gas is produced and there is not enough space for its expansion to occur; this leads to an increase in pressure up to extremely high values that may even burst the breech of the gun.

From the safety point of view, the maximum pressure value is a very useful datum for an appraisal of how close a certain type of ammunition is to its failure limits or to those of a specific weapon.

Nowadays, the employment of heavy ammunitions leads bullets to have higher initial speeds, tauter trajectories and greater kinetic energies, which means greater energies that can be given up, and increased penetration power.

One of the greatest problems of the prior art is given by the fact that free burst functioning with these heavy ammunitions would lead the weapon to undergo structural failures because of the excessive volume of gases produced during the explosion of the projectiles charges.

Gas recovery systems are known in the art, but their only aim is that of expelling the exploded case so as to maintain the automatism in the functioning cycle of the weapon itself.

Since when smokeless gunpowder was discovered, that is more than a century ago, ammunition propellents have been manufactured thanks to techniques which developed with the objective of controlling combustion rate.

Therefore it necessary to find a way to slow down the propellent combustion rate, accomplishing both a decrease in the initial pressure and a saving of part of the charge which is bound to burn later, consequently warranting a pressure which is suitable to the volume generated by the headway movement of the bullet along the muzzle.

SUMMARY OF THE INVENTION

An object of the present invention is that of increasing the volume made available to combustion gases following their expansion, by providing an expansion chamber whose volume can be adjusted.

In other words, according to the present invention, it is possible to adapt the physical features of the gun to the type of ammunition that is to be employed.

According to the invention, there is given a firearm which is equipped with a device, apt to adjust shot initial pressures, by dint of an ad hoc device which is calibrated to the millimeter range.

Such an adjustment device has a simple and rational shape, and it can be envisaged as substantially comprising three mechanical elements; an expansion chamber that communicates with the firearm muzzle through at least one connection hole, moreover a front and a back adjustment screws.

BRIEF DESCRIPTION OF THE DRAWINGS

A better understanding of the features and advantages of the present invention can be gained from the following description, that refers to the attached drawings which illustrate a preferred embodiment of the present invention by way of a not limiting example.

In the drawings.

DETAILED DESCRIPTION OF THE PREFERRED EMBODIMENTS

Figure 1:
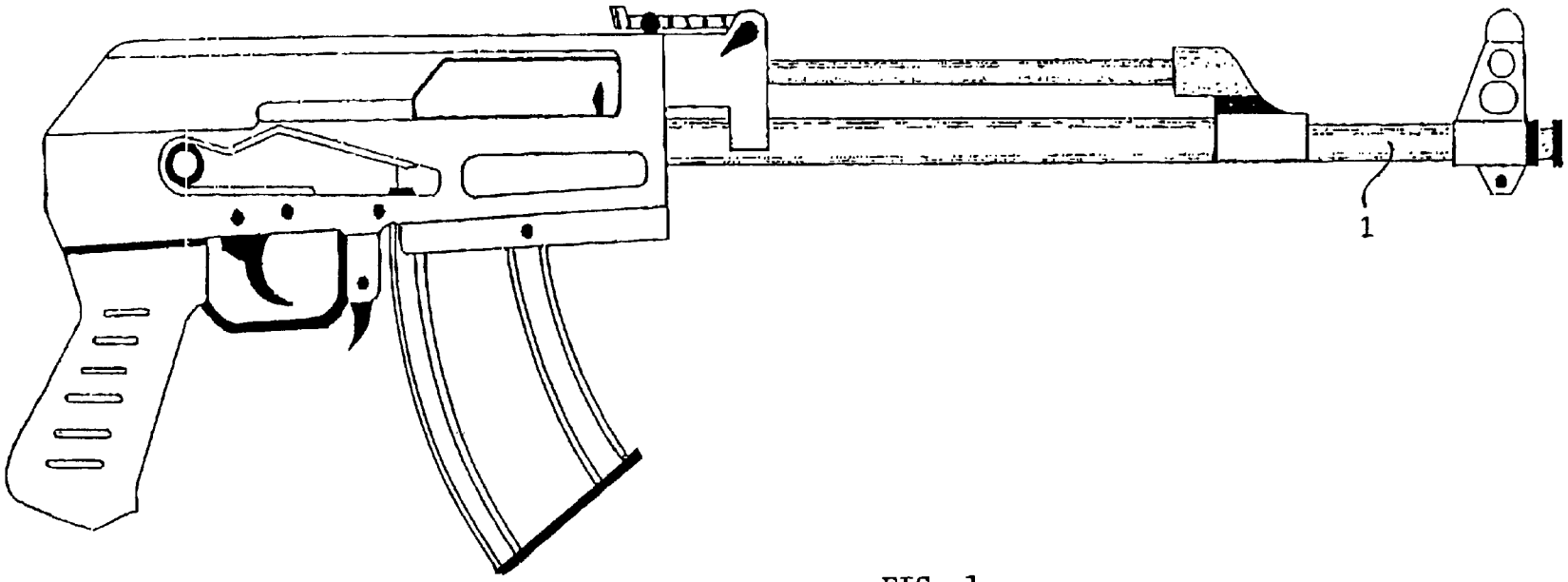
FIG. 1 PRIOR ART
FIG. 1 schematically shows the very popular Soviet Automat-Kalashnikov assault gun.
Figure 2:
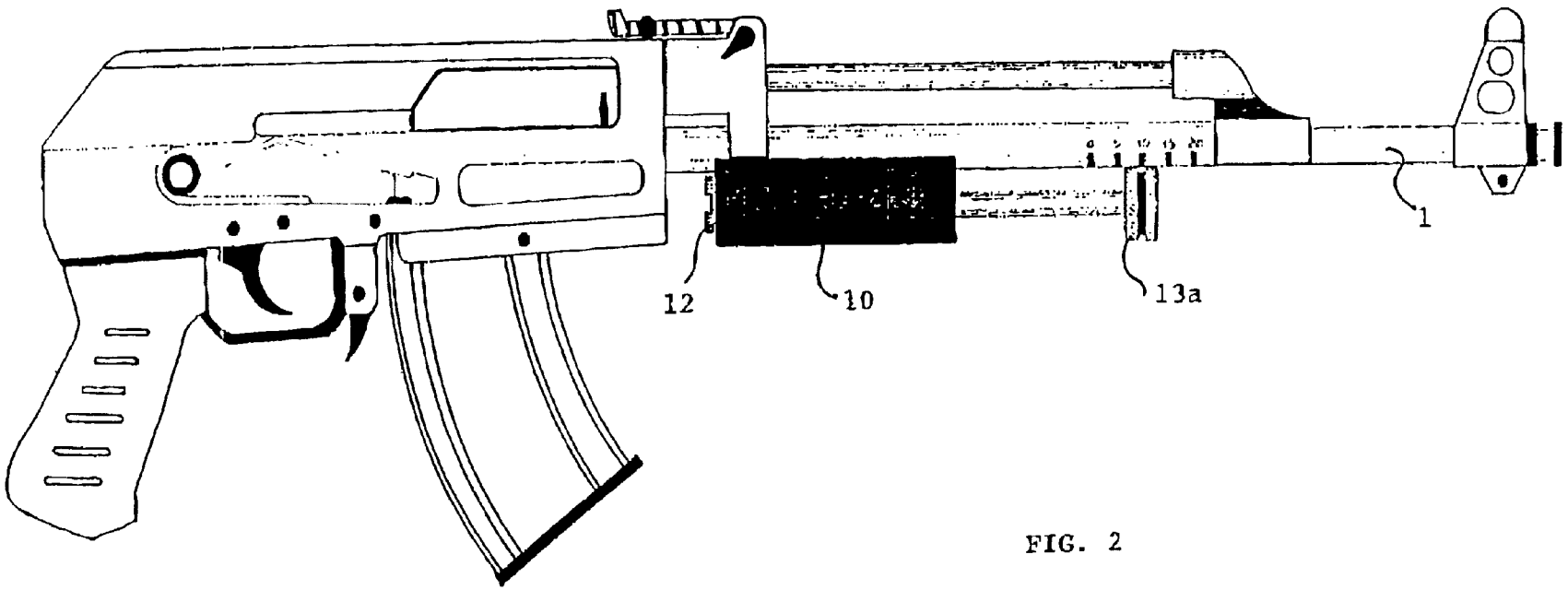
FIG. 2 shows automatic gun shown in FIG. 1, which has been fitted (only by way of example) with the device object of the present invention.
Figure 3:
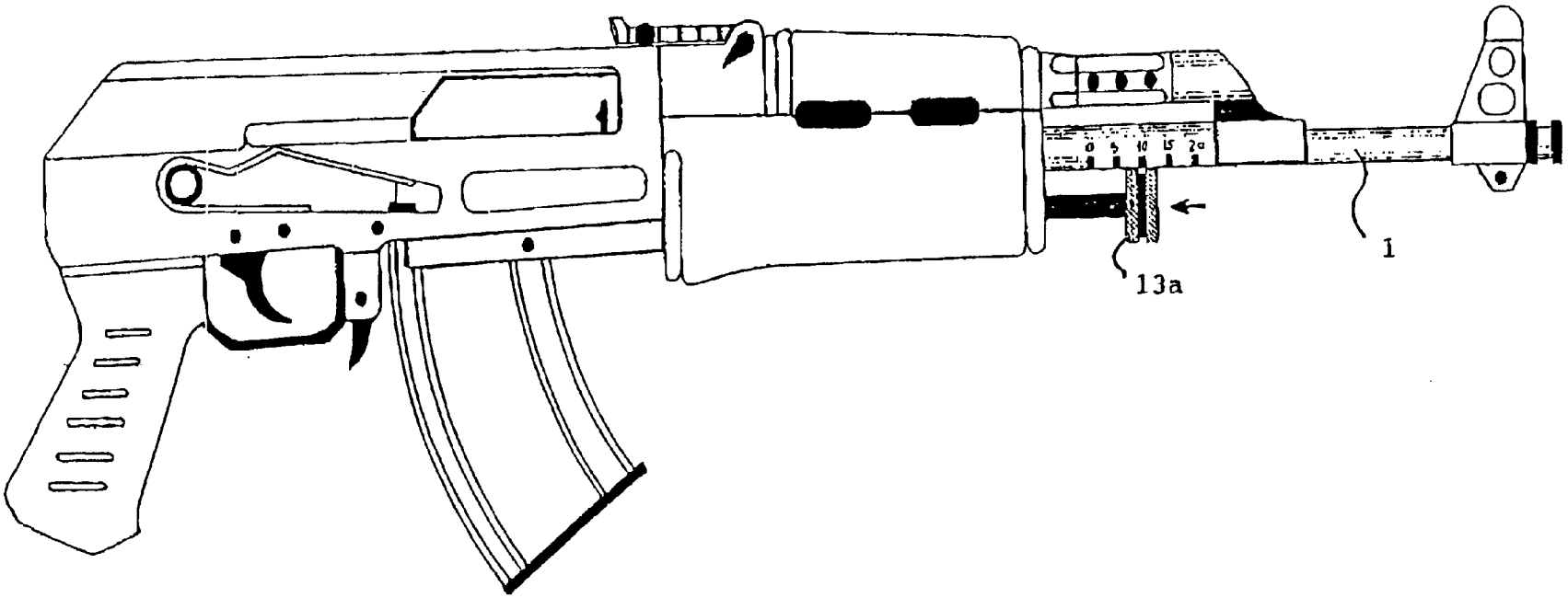
FIG. 3 shows the same gun of FIG. 2, provided with a front guard.

With reference to the figures, in the lower-back portion 9 of the muzzle, (or possibly in its upper part, in any case parallel to it), a hollow expansion chamber 10 is found to be located, said chamber being equipped with an inside threading 11. In its distal back part said threading hosts a clamping screw 12, whilst in its front portion 10, the chamber hosts a second adjustment screw 13, which can be manually operated by virtue of a threaded knob 13*a* located at its end.

The pitch of threading 11 is preferably in the millimeter range (that is one millimeter of axial movement for each full screw turn).

On shooting, a certain portion of the gases given off when combustion of the travelling charge of the cartridge takes place, is bled through one or more holes 14 (there are two of them in the embodiment shown), made in the area that connects the front end of the cartridge chamber with the beginning of the threading, corresponding to the contact area between the muzzle (1) and the chamber (10), area which is parallel to the longitudinal axis.

The optimal boring angle with respect to the muzzle axis is 90°.

Such gases are then conveyed towards the inside of the expansion chamber, compressing the air present inside it. Such an action yields pressures to be reduced to safety levels.

Pressure is reduced proportionally to the chamber's inner volume, therefore it is possible to optimally manage the energy produced by whatever charge load, even that of ammunitions whose charge was not conceived for a specific type of weapon, by simply adjusting screws 12 and 13, that are capable of varying the length and inner volume of the expansion chamber.

The sequence of events that characterize the phenomenon is shown as seen along an axial cross-section of the muzzle/device assembly in FIGS. 4A–4F.

Figures 4A, 4B, 4C:
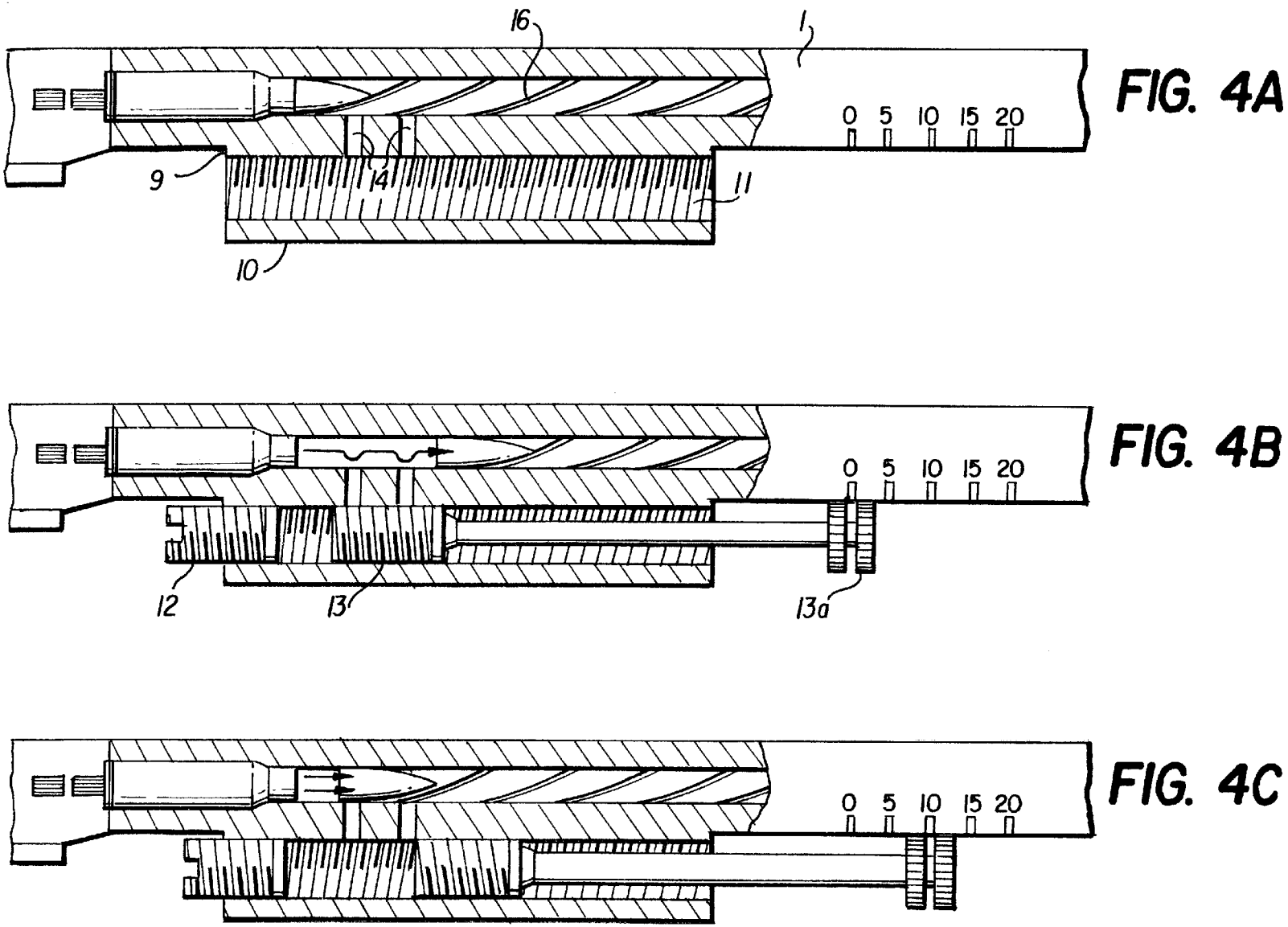
In FIGS. 4A–4F there are schematically shown the several setting possibilities of the device according to the invention.

The drawing of FIG. 4A shows the system as it appears when a cartridge is present in the chamber. Internal threading of the muzzle 1 is indicated as 16. By carrying out an adjustment so as to completely obstruct gas bleed holes 14, as shown in FIG. 4B (that is with the adjustment screw which is completely screwed in and is positioned in correspondence to the "0" mark of an ad hoc graduated scale), none of the gas given off by the shot is taken out of the chamber, therefore the internal ballistic features remain those of a traditional firearm.

Thus, the setting results to be optimal for a correct management of the energy produced by an ammunition characterised by normal charge loading.

In FIG. 4C, the projectile in its acceleration phase is shown, when it is about to reach the nearest or bleeding holes 14. At this stage the pressure is the closest to its highest values.

Figure 4D:
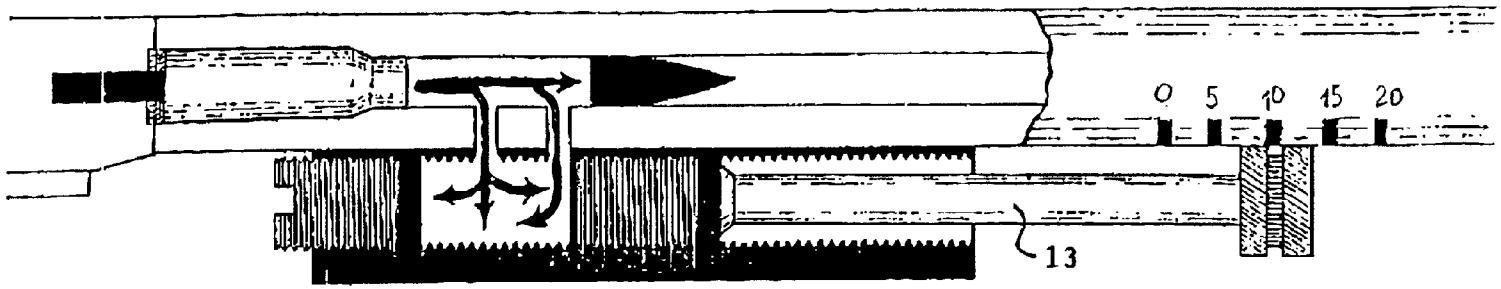

With the setting shown in FIG. 4D, that is with adjustment screw 13 set on the "10" mark of the graduated scale and both holes 14 open, when the projectile by-passes the bleeding holes, an optimal amount of the gases given off flows out of chamber 1, and reaches expansion chamber 10, in so doing causing the air cushion present inside it to be compressed.

Such a phenomenon prevents the gas pressure given by the employment of a high charge load cartridge from getting to its highest values that are excessive and would be rather harmful to both the weapon and the shooter.

Figure 4E:
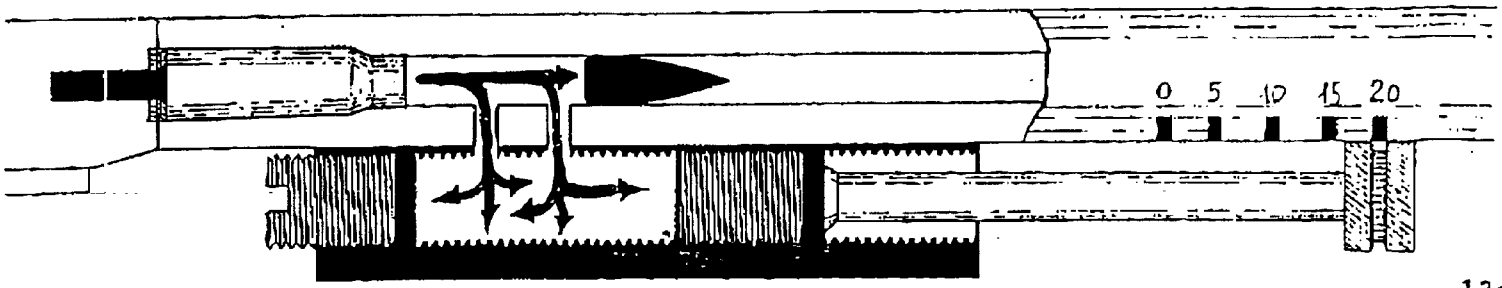

The setting shown in FIG. 4E shows the adjustment screw set at the "20" mark in the graduated scale. In such a case, when the projectile by-passes bleeding holes 14, a different amount of the gases which have been given off flows out of muzzle 1 to reach expansion chamber 10 (with a greater capacity in comparison with the previous setting) and compresses the bulky air cushion present inside it.

Such a sequence ensures that even when the pressure that builds-up from a certain charge is extremely high, it does not reach the tremendous values that it would reach in the normal guns presently known in the art.

To understand how important it is to control such pressures, it suffices to recognize that the real operating pressures normally reached bey such cartridges are in the range of 3000–3500 atmospheres.

Figure 4F:
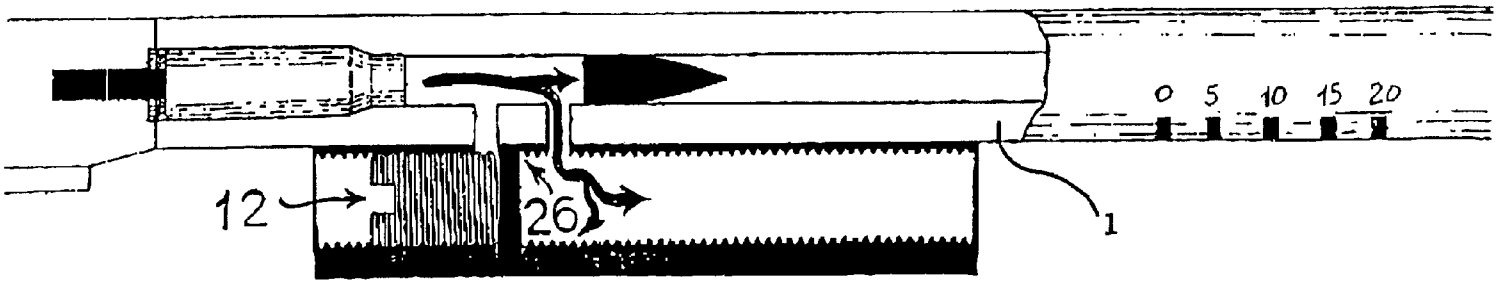
Figure 5:
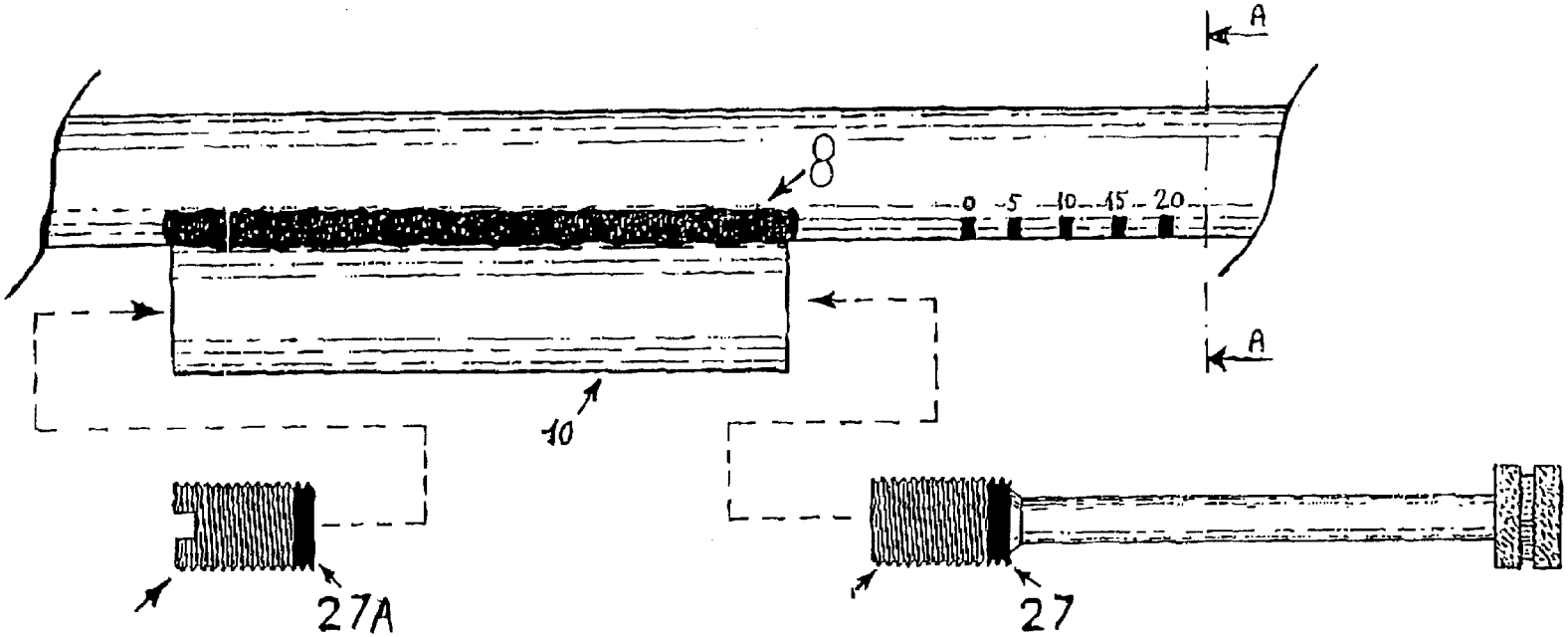
In FIG. 5 the expansion chamber and the assembly of its parts are shown.
Figure 6:
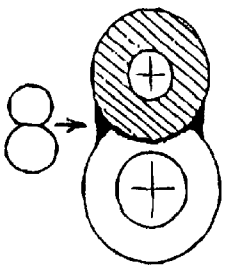
In FIG. 6, a cross-section along the A—A plane of FIG. 5 is shown, and this highlights the fact that the muzzle and the expansion chamber form a welded monobloc.
Figure 7:
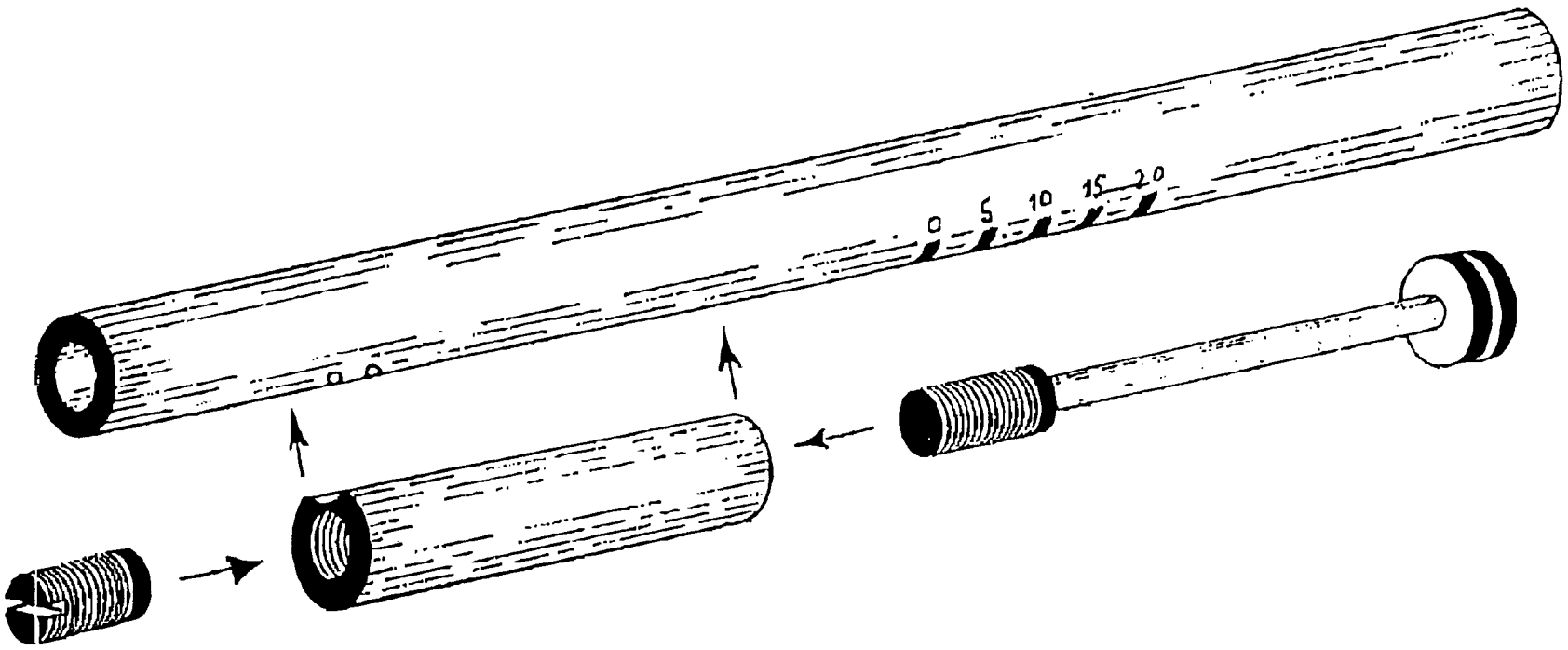
In FIG. 7, an exploded perspective view of the system is shown.

Finally, the setting shown in FIG. 4F highlights how back clamping screw 12 is also capable of accomplishing the obstruction of the nearest of holes 14, halving the flow rate of the gas that is bound to be conveyed into expansion chamber 10 underneath.

In order to do this, it is sufficient to screw in said back screw 12 until it reaches the position shown by reference number 26.

In conclusion, screws 12 and 13 are advantageously equipped with their respective sealing rings 27 and 27A, which are made of heat enduring elastic material and accomplish their double aim of avoiding any possible pressure losses along the threading and of eliminating the even remote possibility of undesired uscrewings.

The present invention has been described and illustrated in terms of one of its preferred embodiments, but it is given for granted that those skilled in the art may make changes and amendments without stepping out of the scope of the present patent.

What is claimed is:

1. A firearm comprising:

a barrel having rifling; and a device for adjusting the volume available to the expansion of combustion gases as to regulate the pressure developed, in the volume available to the expansion of combustion gases, during firing of said firearm such that said firearm is suitable to the employment of ammunition having differing charges, said device comprising:

(i) an expansion chamber connected to the barrel of said firearm through at least one connection hole of the barrel disposed near the beginning of the rifling;

(ii) a front calibration screw, capable of being rotated into or out of said expansion chamber to calibrate said firearm for a particular ammunition; and (iii) a back calibration screw, capable of being rotated into or out of said expansion chamber to calibrate said firearm for a particular ammunition, wherein said expansion chamber is parallel to said barrel and is located in a lower-back portion of said barrel or in an upper portion of said barrel, said expansion chamber comprising an inside threading capable of engagement with said back calibration screw and said front calibration screw, said front calibration screw capable of being operated manually by a threaded knob.

2. The firearm according to claim 1, wherein said threading has a pitch in the millimeter range to provide a one millimeter long axial movement for each rotation of said front calibration screw.

3. The firearm according to claim 1, wherein said at least one connection hole is disposed in an area that connects a front end of a cartridge chamber and an initial portion of said rifling, corresponding to where said barrel is tangent to said expansion chamber and is parallel to a longitudinal axis along the length of said barrel.

4. The firearm according to claim 1, wherein said front calibration screw and said back calibration screw are capable of changing the volume of said expansion chamber.

5. The firearm according to claim 1, wherein said barrel has at least two said connection holes.

6. A firearm comprising:

a barrel having rifling; and a device for adjusting the volume available to the expansion of combustion gases as to regulate the pressure developed, in the volume available to the expansion of combustion gases, during firing of said firearm such that said firearm is suitable to the employment of ammunition having differing charges, said device comprising:

(i) an expansion chamber connected to the barrel of said firearm through at least one connection hole of the barrel disposed near the beginning of the rifling;

(ii) a front calibration screw, capable of being rotated into or out of said expansion chamber to calibrate said firearm for a particular ammunition; and (iii) a back calibration screw, capable of being rotated into or out of said expansion chamber to calibrate said firearm for a particular ammunition, wherein an angle between (i) an axis of said at least one connection hole, defined as the axis of said connection hole from said expansion chamber to said barrel and (ii) an axis of said barrel, is 90°.

7. The firearm according to claim 6, wherein said front calibration screw and said back calibration screw are capable of changing the volume of said expansion chamber.

8. A firearm comprising:

a barrel having rifling; and a device for adjusting the volume available to the expansion of combustion gases as to regulate the pressure developed, in the volume available to the expansion of combustion gases, during firing of said firearm such that said firearm is suitable to the employment of ammunition having differing charges, said device comprising:

(i) an expansion chamber connected to the barrel of said firearm through at least one connection hole of the barrel disposed near the beginning of the rifling;

(ii) a front calibration screw, capable of being rotated into or out of said expansion chamber to calibrate said firearm for a particular ammunition; and (iii) a back calibration screw, capable of being rotated into or out of said expansion chamber to calibrate said firearm for a particular ammunition, wherein said front calibration screw and said back calibration screw each further comprising a heat resistant rubber sealing material.

9. The firearm according to claim 8, wherein said front calibration screw and said back calibration screw are capable of changing the volume of said expansion chamber.

10. A firearm comprising:

a barrel having rifling; and a device for adjusting the volume available to the expansion of combustion gases as to regulate the pressure developed, in the volume available to the expansion of combustion gases, during firing of said firearm such that said firearm is suitable to the employment of ammunition having differing charges, said device comprising:

(i) an expansion chamber connected to the barrel of said firearm through at least one connection hole of the barrel disposed near the beginning of the rifling;

(ii) a front calibration screw, capable of being rotated into or out of said expansion chamber to calibrate said firearm for a particular ammunition; and (iii) a back calibration screw, capable of being rotated into or out of said expansion chamber to calibrate said firearm for a particular ammunition, wherein said front calibration screw and said back calibration screw each have a longitudinal axis parallel to a longitudinal axis of the barrel and are capable of being moved to adjust the length of the volume of the expansion chamber.

11. A firearm comprising:

a barrel having rifling; and a device for adjusting the volume available to the expansion of combustion gases as to regulate the pressure developed, in the volume available to the expansion of combustion gases, during firing of said firearm such that said firearm is suitable to the employment of ammunition having differing charges, said device comprising:

(i) an expansion chamber connected to the barrel of said firearm through at least one connection hole of the barrel disposed near the beginning of the rifling;

(ii) a front calibration screw, capable of being rotated into or out of said expansion chamber to calibrate said firearm for a particular ammunition; and (iii) a back calibration screw, capable of being rotated into or out of said expansion chamber to calibrate said firearm for a particular ammunition, wherein said front calibration screw and said back calibration screw each have a diameter equal to the inner diameter of the expansion chamber.

12. A firearm comprising:

a barrel having rifling; and a device for adjusting the volume available to the expansion of combustion gases as to regulate the pressure developed, in the volume available to the expansion of combustion gases, during firing of said firearm such that said firearm is suitable to the employment of ammunition having differing charges, said device comprising:

(i) an expansion chamber connected to the barrel of said firearm through at least one connection hole of the barrel disposed near the beginning of the rifling;

(ii) a front calibration screw, capable of being rotated into or out of said expansion chamber to calibrate said firearm for a particular ammunition; and (iii) a back calibration screw, capable of being rotated into or out of said expansion chamber to calibrate said firearm for a particular ammunition, wherein said expansion chamber is structured for being connected parallel to the barrel and for being located in a lower-back portion of the barrel or in an upper portion of the barrel, said expansion chamber comprising an inside threading capable of engagement with said back calibration screw and said front calibration screw, said front calibration screw capable of being operated manually by a threaded knob.

13. The firearm according to claim 12, wherein said threading has a pitch in the millimeter range to provide a one millimeter long axial movement for each rotation of said front calibration screw.

14. The firearm according to claim 12, wherein said at least one connection hole is disposed in an area that connects a front end of a cartridge chamber and an initial portion of said rifling, corresponding to where said barrel is tangent to said expansion chamber and is parallel to a longitudinal axis along the length of said barrel.

15. The firearm according to claim 12, wherein said front calibration screw and said back calibration screw are capable of changing the volume of said expansion chamber.

16. The firearm according to claim 12, wherein said front calibration screw and said back calibration screw each further comprise a heat resistant rubber sealing material.

17. The firearm according to claim 12, wherein said front calibration screw and said back calibration screw each have a longitudinal axis parallel to a longitudinal axis of the barrel and are capable of being moved to adjust the length of the volume of the expansion chamber.

18. The firearm according to claim 12, wherein said front calibration screw and said back calibration screw each have a diameter equal to an inner diameter of the expansion chamber.

19. The firearm according to claim 12, wherein said expansion chamber has a length suitable for communication with at least two connection holes of the barrel.

* * * * *